United States Patent [19]

Nirenberg

[11] 4,096,714

[45] Jun. 27, 1978

[54] SELF-CONTAINED GARMENT TREATING APPARATUS

[76] Inventor: Robert P. Nirenberg, 1314 17th St., #32, Santa Monica, Calif. 90404

[21] Appl. No.: 747,232

[22] Filed: Dec. 3, 1976

[51] Int. Cl.[2] ..... D06B 5/24

[52] U.S. Cl. ..... 68/5 C; 68/5 E; 68/18 C; 219/275; 261/121 R

[58] Field of Search ..... 68/5 C, 5 E, 6, 18 C; 8/149.2, 149.3; 223/51, 70, 73, 76; 34/72, 92; 312/1, 3, 4; 219/275, 271; 21/118, 119

[56] References Cited

U.S. PATENT DOCUMENTS

| | | | |
|---|---|---|---|
| 1,103,806 | 7/1914 | Mertz | 68/5 C |
| 1,796,039 | 3/1931 | Mijer | 8/149.2 |
| 3,051,163 | 8/1962 | Trexler | 312/1 |
| 3,486,307 | 12/1969 | McDermott | 261/17 X |
| 3,513,669 | 5/1970 | Nirenberg | 68/5 C |
| 3,675,360 | 7/1972 | Pierce | 219/275 X |
| 3,709,005 | 1/1973 | Keating et al. | 34/72 X |
| 3,712,086 | 1/1973 | Payet et al. | 68/5 C |
| 4,009,002 | 2/1977 | Carter | 8/149.2 X |

*Primary Examiner*—Philip R. Coe
*Attorney, Agent, or Firm*—Louis J. Bachand

[57] ABSTRACT

Self-contained apparatus for vapor phase treating of garments with durable press treating agents. The apparatus comprises a vaporized treating agent supply tank, a pressurizable treating chamber for enclosing garments to be agent treated, and an unused treating agent recovery means, the assembly being adapted to cyclically depressurize and repressurize the chamber interior in timed relation to the presence of treating agent in the chamber to relatively pressure impregnate the garments with the treating agent.

8 Claims, 5 Drawing Figures

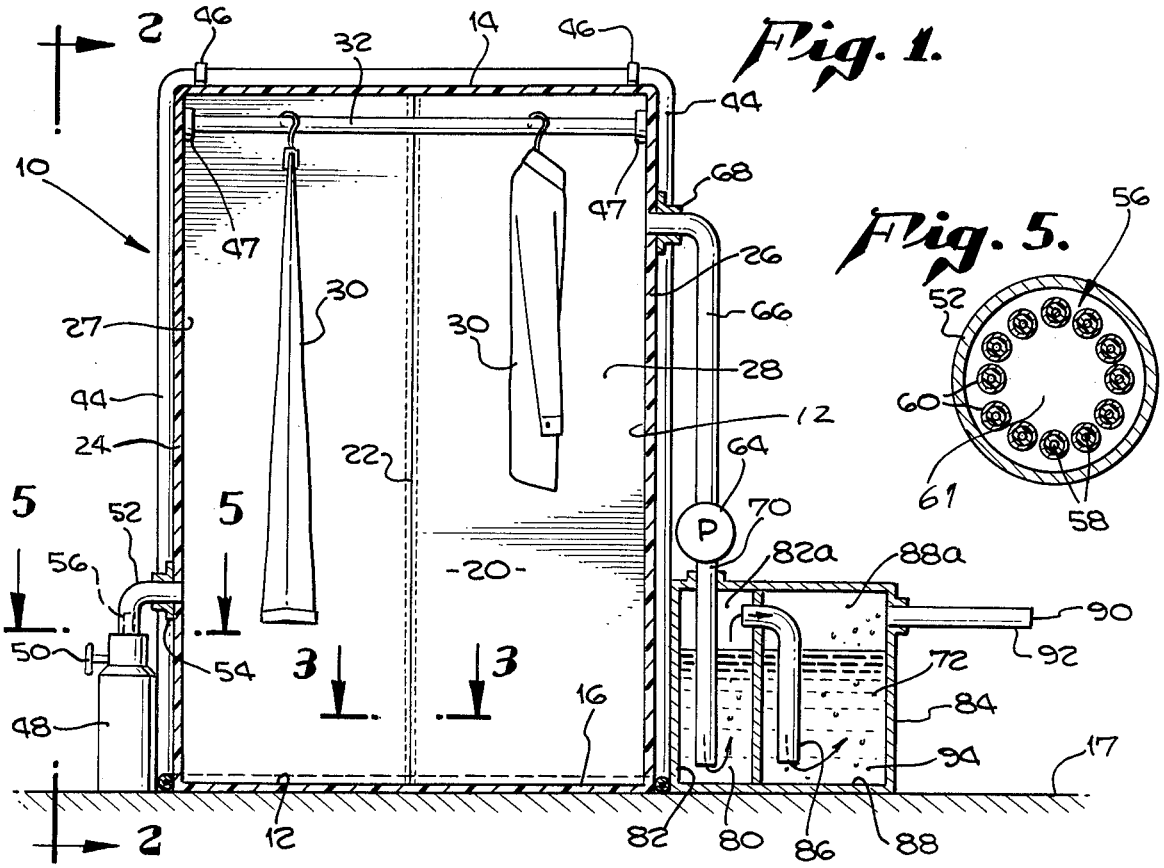
Fig. 1.
2
46
32
14
46
44
10
47
47
68
26
66
27
30
30
28
44
12
24
22
64
5
5
52
70
P
56
-20-
82a
88a
90
50
54
3
3
72
92
16
84
48
94
17
12
82
80
86
88
2
Fig. 5.
56
52
60
61
58
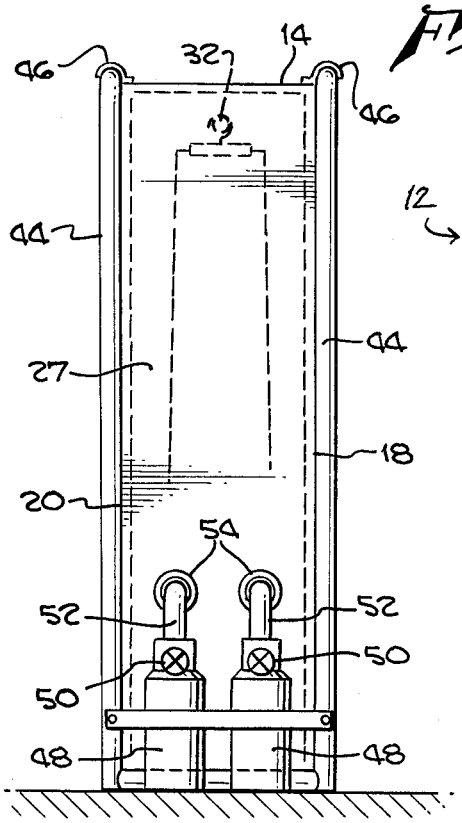
Fig. 2.
46
32
14
46
44
44
27
18
20
54
52
52
50
50
48
48
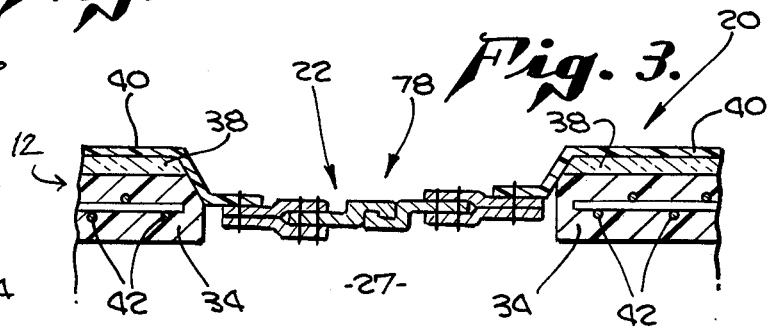
Fig. 3.
20
40
22
78
38
38
40
12
42
34
-27-
34
42
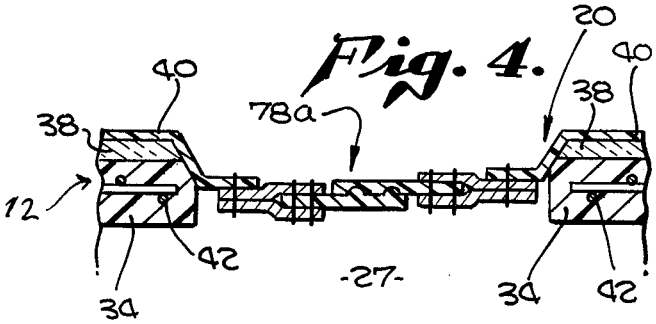
Fig. 4.
20
40
40
38
78a
38
12
42
-27-
34
34
42

SELF-CONTAINED GARMENT TREATING APPARATUS

BACKGROUND OF THE INVENTION

This invention has to do with improvements in apparatus for durable press treating of fabric, particularly fabric made up into garments, with vapor phase treating agents. The invention is further concerned with techniques for durable press treating of garments in the vapor phase whereby effective treatments are effected in a rapid, environmentally acceptable and materials consumption efficient manner. In a particular sense, the invention provides improvements in apparatus of a type useful for on-site treating of garments e.g. by small manufacturers, cleaners of fabrics, and others having a specific need to treat garments with durable press agents without cumbersome and costly full-scale production equipment, such as is used in the commercial production of treated fabric, either by the wet process or the vapor phase process.

PRIOR ART

It is known to treat fabrics and fabrics made up into garments with durable press agents, the agents being known per se, for the purpose of imparting wrinkle-resistance and pleat or crease retention. Ofttimes fabrics are treated by a wet process prior to being made up into garments. In other instances, garments having been made up are treated to impart the desirable characteristics of durable press. In my earlier patent, U.S. Pat. No. 3,513,669 I disclosed apparatus for vapor phase treatment of articles, including garments, wherein the durable press treating agents were introduced into a treating chamber of substantial construction driven by a blower through and around the chamber wherein garments to be treated were disposed, and thereafter withdrawn. The apparatus disclosed relied upon gas flow to carry the treating agents to the garments and the gas flow movement to impregnate the garments with the vapor phase treating agents. Overpressures within the treating chamber were avoided through the use of pressure responsive vents. While this apparatus is effective for its intended purpose, there exists a need for a self-contained and portable system not designed for factory production levels particularly, and one which is accordingly lower in cost, easily installed and moved from an installation site, and one which is efficient in terms of materials consumption.

SUMMARY OF THE INVENTION

Accordingly, the present invention provides an improvement on known apparatus for vapor-phase treating of garments with durable press treating agents. Specifically, the invention provides a self-contained, portable, collapsible and low-cost, easily installed and readily moved apparatus suitable for treating garments on a scale that might be employed at a small manufacturer of garments or at a cleaning establishment wherein it is desired to originally impart or to renew durable press characteristics to already formed garments.

It is a signal feature of the invention that pressurization of the treating chamber is employed, rather than simple gas flow to increase treating contact of the vapor phase reagents with the garments to be treated, effecting economies in operating time and materials consumption, as well as simplifying and reducing the cost of the equipment needed, in accordance with the objectives of the invention.

Accordingly, the invention provides a self-contained apparatus for vapor-phase treatment of garments with durable press treating agents, which comprises a vaporized treating agent supply, a pressurizable treating chamber for enclosing garments to be agent treated, and an unused treating agent recovery means, adapted to cyclically depressurize and repressurize the chamber interior in timed relation to the presence of treating agent in the chamber, to relatively pressure-impregnate the garments with the treating agent.

The treating agent supply may comprise a tank of treating agent liquid, a valved inlet communicating the tank and the treating chamber interior, and a means of volatilizing the liquid for passage into the chamber interior. The volatilizing means typically including a normally gaseous propellant within the tank in treating agent delivering relation to the chamber interior. Additionally, the volatilizing means may include a heater for flash vaporizing the treating agent liquid exteriorly of the chamber.

The agent recovery means typically includes a scrubbing tank containing treating agent neutralizing liquid, and means contacting unused treating agent vapor with the neutralizing liquid within the tank and exteriorly of the chamber. The treating agent scrubbing tank may further include an outlet tube sparging unused treating agent from the chamber interior into the neutralizing liquid. More particularly, the agent recovery tank may comprise first and second compartments, the first compartment having a head space closed to the atmosphere and the second compartment having a head space open to the atmosphere, the neutralizing agent being present in both compartments, the outlet tube sparging unused treating agent into the first compartment for neutralization in both first and second compartments and in sequence. There may further be provided in accordance herewith means communicating the first tank compartment head space with the neutralizing liquid in the tank second compartment.

The apparatus further includes wall means defining the chamber, and a garment passing opening into the chamber, the opening having a gast tight closure. The wall means may be coated and internally heated against treating agent deposit thereon, and be sufficiently flexible to be folded upon themselves and supported by a rigid frame to define the chamber. Accordingly, in a specific embodiment, the wall means comprise a flexible sheet having a chamber surface of treating agent deposit resistant synthetic organic plastic, resistance heating elements embedded within the wall means in chamber surface heating relation, and heat insulative material limiting heating of the non-chamber surface of the wall means.

In particularly preferred embodiments, the apparatus includes pump means adapted to evacuate the chamber, the treating agent supply being pressurized relative to the evacuated chamber interior to deliver treating agents into the chamber in repressurizing relation to pressure treat the garments with the treating agents. The pump means may be connected to evacuate the chamber into the recovery means, depressurizing the chamber for further repressurization with treating agent and cyclically in timed relation to the presence of garments in the chamber through the wall means opening. In this embodiment, the treating agent recovery means may include a scrubbing tank containing treating agent neutralizing liquid, and the chamber outlet tube may be in sparging communication with the neutralizing liquid in the tank, the pump then delivering the treating agent into the tank through the outlet tube in chamber evacuating and depressurizing relation. And with reference to the treating agent supply in this embodiment, such supply may comprise a tank beyond the wall of the chamber and containing treating agent liquid under pressure above that of the evacuated chamber from a normally gaseous propellant, a valved inlet communicating the tank and the chamber interior through the wall means, and a heater at the tank flash volatilizing the treating agent for passage through the inlet into the chamber under propellant pressure.

Additional features of the preferred embodiments include the agent recovery tank comprising first and second compartments, the first compartment having a head spaced closed to the atmosphere and the second compartment having a head space open to the atmosphere; the neutralizing liquid being present in both compartments, the outlet tube sparging unused treating agent into the first compartment for neutralization in the first and second compartments, in sequence; and further, means communicating the tank first compartment head space with the neutralizing liquid in the tank second compartment; and wall means defining the chamber and a garment-passing opening; into the chamber, the opening having a gas tight closure; said wall means being coated and internally heated against treating agent deposit thereon, e.g. the wall means comprising a flexible sheet having a chamber surface of treating agent deposit resistant synthetic organic plastic, resistance heating elements embedded within the wall means in chamber surface heating relation, and heat insulative material limiting heating of the non-chamber surface of the wall means, the sheet being supported by a rigid frame in chamber defining relation.

BRIEF DESCRIPTION OF THE DRAWINGS

The invention will be further described as to an illustrative embodiment in conjunction with the attached drawings, in which:

FIG. 1 is a view in vertical section of apparatus according to the invention;

FIG. 2 is a view in side elevation of the apparatus taken on line 2—2 in FIG. 1;

FIG. 3 is a detail view in transverse section and greatly enlarged of the closure means taken on line 3—3 in FIG. 1;

FIG. 4 is a view like FIG. 3 of an alternate form of wall means closure; and

FIG. 5 is a view taken on line 5—5 of FIG. 2, and enlarged.

DESCRIPTION OF THE PREFERRED EMBODIMENTS

With reference now to the drawings in detail, the apparatus 10 is shown in FIGS. 1 and 2 to comprise sheet material panels generally indicated by numeral 12 and specifically arranged to define a top wall 14, a bottom wall 16 resting on floor 17, a rear wall 18, a front wall 20 having sealing closure 22 thereon and left side wall 24 and right side wall 26. These panels are sewn or heat or solvent sealed together to define a vapor tight and pressurizable chamber 27 sized as indicated to provide an enclosure interior 28 for garments 30 to be treated, supported within the enclosure interior 28 on rack 32.

As best seen in FIG. 3, the sheet material wall panels 12 are laminates of a high temperature resistant, generally nonpolar inner surface layer 34 e.g. of Teflon, silicone and the like, optionally reinforced with an additional layer of tough flexible plastic, also high temperature resistant, e.g. polycarbonate, silicone, rubber or the like (not shown) and an outer layer 38 of heat insulative material, e.g. fiberglass 38, suitably covered with a cloth or plastic fabric covering 40.

Embedded within the wall panel surface layer 34 are multiple wires 42 defining an electrical resistance heater distributed throughout the wall panels 12 for purposes to appear.

The wall panels 12 are supported in their assembled relation by circumferential support frame 44 formed of pipe or the like and secured to the side walls 24, 26 by hook fasteners 46. Rack 32 is supported by reinforcements 47 on side walls 24, 26, its weight being transferred thereby to the frame 44. A typical chamber may be 5 feet in height, 4 feet wide and 2 feet deep.

The treating agent supply comprises one or more tanks 48 communicating with the interior 28 of chamber 12. The tanks 48 are pressure resistant vessels containing generally liquid, but vaporizable garment durable press treating agents, e.g. those referred to my earlier patent mentioned above, and more particularly a solution of a formaldehyde donor, a fiber swelling agent, an activator or catalyst, and water. This treating solution, known per se, or a like durable press imparting agent is pressurized within the tank by a propellant. The term "propellant" herein refers to normally gaseous but liquifiable (or subliming) material which can be placed in a container to pressurize the contents, such as are used in aerosol "bombs." Among such materials there may be mentioned carbon dioxide, nitrogen, halohydrocarbons such as fluorocarbons and chlorofluorocarbons. The particular propellant is not critical, provided the material is inert with respect to the durable press agents and provides sufficient pressure within the tank 48 to deliver the agent into the chamber interior 28.

The treating agent tanks 48 may be two in number as shown, or more. A typical tank might contain about 1 quart to 1.5 quarts of the treating agent plus propellant sufficient to deliver the agent into the chamber interior 28, or enough for one treatment in a chamber 27 of the size indicated above. Additional tanks will enable additional treatments. One aspect of the apparatus self-containment is thus apparent. The treating agent tanks can be readily replaced on a one-tank, one-use basis; the tank being provided from a central supply to particular users much as industrial gases are supplied to welding shops.

The treating agent is passed from the tank 48 by opening valve 50 and letting the agent under propellant pressure enter conduit 52 which enters the chamber 27 through fitting 54 in left side wall 24 in sealed relation.

A longitudinal portion of conduit 52 is defined by a flash heater 56 best shown in FIG. 5 and comprising a circular series of heater tubes 58 having a central core of electrically heatable wire 60, tubes being surrounded by conduit 52, to define a passage 61 for the contents of tank 48 in which heat is applied (up to 325°-350° F) to the tank contents, heating them to vaporization, the produced vapors then passing into the chamber interior 28 as the vapor supply to the chamber.

Prior to activating delivery of the treating agent vapor, the chamber interior 28 into which garments 30 have been placed on rack 32 and through opening 22

(subsequently reclosed pressure-tightly) is depressurized, i.e. the interior pressure is reduced below ambient or atmospheric pressure, creating within the chamber 12 and the garments 30 a negative pressure condition, e.g. of 2 to 5 inches of water below atmosphere.

The depressurization of the chamber interior 28 is accomplished by pump 64 communicating on its suction side with the chamber interior, through conduit 66 which enters right side wall 26 of the chamber 27 through fitting 68, and on the pump pressure side, conduit 70 communicates the pump with scrubbing 72 to be described.

After the pump 64 has depressurized the chamber interior 28, the valve 50 on treating agent tank 48 is opened, the treating agent released under propellant pressure passes through conduit 52, is vaporized by heater 56 and, as a vapor, enters chamber interior 28. Because of the negative pressure condition within the chamber 27 and garments 30 therein, substantive contact of the vapor with the garments is effected rapidly and effectively. The treating agent appears to pressure-impregnate and polymerize within and on the fabric fiber interstices and an overall high level of durable press treatment is realized. Treatment times of 5 minutes to 1 hour or more may be used, and preferably 15 to 20 minutes, depending on the quantity of garments 30 being treated, the pressure differential between tank 48 and chamber interior 28, the treating agent used, the extent of treatment desired and like variable factors.

To prevent deposition of the treating agent on the chamber interior walls, these walls are internally heated and anti-deposition coated. With reference to FIG. 3, front wall 20, which is typical in this respect, is shown, Wall 20 comprises an inner layer 34 (faces the chamber interior 28) of Teflon, silicone or like nonadherent, inert polymer having suitable temperature resistance. The inner layer has embedded within it a distributed series of electrical resistance wires or screen 42 which are capable of heating the exposed surface of inner layer 34 to a temperature at which the vapor introduced into the chamber interior 28 will not polymerizingly deposit, e.g. 225°-300° F.

The quantity of vapor introduced into chamber interior 28 is such as replaces from 25% to 150% or more or less of the quantity of air or like gas evacuated from the chamber by blower-pump 64. This is, typically, the chamber interior 28 pressure will be not less than 110% and preferably will be 125% to 250% of the atmospheric pressure when vapor pressurized. The chamber 27 being flexibly walled may assume concave or convex shapes during the treatment cycle, reflecting the depressurization and repressurization.

The invention further provides for recovery of unused treating agent. The purpose of this recovery is not reuse of these agents, but the satisfaction of most stringent environmental considerations, including minimum release of displeasing olefactory vapors. Accordingly, following garment treatment, and prior to opening the chamber 27 by disengaging the tongue-in-groove closure 78 shown in FIG. 3 or the alternate double tongue, double groove closure **78*a* shown in FIG. 4, the pump 64 is again activated and the gases and unused vapor within chamber interior 28 exhausted. These removed gases and unused vapors are passed through conduit 70 which, as shown (FIG. 1), terminates beneath the surface of neutralizing liquid 80** in a manner to sparge the gases and vapors into the liquid.

Suitable liquids for neutralization include materials which will precipitate, complex, polymerize or absorb the unused vapors, i.e. render them less volatile, to preclude their release from the surface of liquid 80. Typical materials known for this purpose include sodium carbonate, sodium bicarbonate, sodium bisulfate, various dicyandiamides, ammonium hydroxide, sodium hydroxide and potassium hydroxide and like scrubbers for amine type materials, and formaldehyde vapors.

The mixed vapors and gases are released by conduit 70 into liquid 80. Vapors are scrubbed from the gases, as the gases pass upwardly through the liquid 80. The gases released from the surface of neutralizing liquid 80 in the first compartment 82 of scrubbing tank 84 of recovery unit 72 enter the head space **82*a* thereof and are conveyed, by pressure differential, through tube 86 to tank second compartment 88 having head space 88*a* which is in open communication with the atmosphere at 90 through vent pipe 92. The gases passing into compartment 88 are further scrubbed in this compartment liquid 94, pass into head space 88*a*, and are released to the atmosphere at 90 only after they rise through neutralizing liquid 94**, scrubbed clean of offensive vapors, by the compartments indicated, or multiplied banks of such compartments, as necessary.

I claim:

1. Self-contained apparatus for vapor phase treating of garments with durable press treating agents, comprising a pressurized agent supply, a pressurizable treating chamber for enclosing garments to be agent treated, means to vaporize said treating agent, means to feed the vaporized treating agent into said treating chamber for pressurizing said treating chamber and for treating the garments with said treating agent, pump means communicating with said treating chamber for withdrawing unused treating agent from said treating chamber and for cyclically depressurizing the chamber interior in time relation to said agent supply repressurizing said chamber with treating agent to relatively pressure-impregnate the garments with said treating agent in vapor phase, and means in flow communication with said pump means for recovery of unused treating agent.

2. Apparatus according to claim 1 in which said treating agent supply comprises a tank beyond a wall of said chamber and containing treating agent liquid under pressure above that of the evacuated chamber from a normally gaseous propellant, a valved inlet communicating said tank and the chamber interior through said wall, and a heater at the tank for flash-volatilizing said treating agent for passage through said inlet and into said chamber under propellant pressure.

3. Apparatus according to claim 2 in which said treating agent recovery means includes a scrubbing tank containing treating agent neutralizing liquid, and a chamber outlet tube in sparging communication with neutralizing liquid in said tank, said pump delivering said treating agent into said tank through said outlet tube in chamber evacuating and depressurizing relation.

4. Apparatus according to claim 3 in which said agent scrubbing tank comprises first and second compartments, the first compartment having head space closed to the atmosphere, the second compartment having head space open to the atmosphere, said outlet tube sparging unused treating agent into the first compartment for neutralization in said first and second compartments in sequence.

5. Apparatus according to claim 4 including also means communicating with the tank first compartment head space with the neutralizing liquid in the tank second compartment.

6. Apparatus according to claim 5 including also wall means defining said chamber, and a garment passing opening into said chamber, said opening having a gas tight closure.

7. Apparatus according to claim 6 in which said wall means are coated and internally heated against treating agent deposit thereon.

8. Apparatus according to claim 7 in which said wall means comprise a flexible sheet having a chamber surface of treating agent deposit resistant synthetic organic plastic, resistance elements embedded within the wall means in chamber surface heating relation, and heat insulative material limiting heating of the non-chamber surface of said wall means, and including also a rigid frame supporting said wall means in chamber defining relation.

* * * * *